US005505443A

United States Patent [19]

Padilla

[11] Patent Number: 5,505,443

[45] Date of Patent: Apr. 9, 1996

[54] COMBINATION BALL-HITTING AND PITCHING PRACTICE APPARATUS

[76] Inventor: Ronald G. Padilla, 12029 W. Tanforan St., Morrison, Colo. 80465

[21] Appl. No.: 509,430

[22] Filed: Jul. 31, 1995

[51] Int. Cl.[6] ..... A63B 69/40

[52] U.S. Cl. ..... 273/26 R; 273/26 E; 273/26 A; 273/411

[58] Field of Search ..... 273/26 R, 29 A, 273/411, 410, 26 E

[56] References Cited

U.S. PATENT DOCUMENTS

| | | | |
|---|---|---|---|
| 2,839,300 | 6/1958 | Blaha | 273/26 A |
| 2,978,246 | 4/1961 | Groningen | 273/26 A |
| 3,006,647 | 10/1961 | Haskett | 273/26 E |
| 3,602,504 | 8/1971 | Chapman | 273/411 |
| 3,994,494 | 11/1976 | Kelley | 273/26 E |
| 5,098,094 | 3/1992 | Kita | 273/26 E |
| 5,106,085 | 4/1992 | Lewy | 273/26 E |
| 5,282,615 | 2/1994 | Green | 273/26 E |

FOREIGN PATENT DOCUMENTS

| | | | |
|---|---|---|---|
| 1644988 | 4/1991 | U.S.S.R. | 273/411 |

*Primary Examiner*—Theatrice Brown
*Attorney, Agent, or Firm*—Charles Corbin

[57] ABSTRACT

Disclosed is a combination ball-hitting practice and ball-pitch-back apparatus, having a vertical support pole with a lower end designed for anchoring the pole to the ground to support it upright, and including a ball-tee support member that has one end connected to the support pole for vertical adjustment therealong, its opposite end being structured to releasably support a ball for striking. An extension arm is telescopically mounted in the upper end of the support pole, and a ball-rebounding net and a tethered ball are mounted to a support frame which is adjustably connected to the upper end of the extension arm.

3 Claims, 1 Drawing Sheet

COMBINATION BALL-HITTING AND PITCHING PRACTICE APPARATUS

BACKGROUND OF THE INVENTION

1. Field of the Invention

The present invention relates to devices by which children can learn and practice baseball skills, and more particularly relates to such a device that adjustably mounts a ball-rebound net as well as means for practicing hitting stationary balls.

2. Description of the Prior Art

Conventional sports equipment by which children can learn and practice how to hit and pitch a ball, are quite limited. Although it is known to use rebound nets to practice pitching and throwing at a target, conventional devices tend to the heavy, cumbersome, and often are not easily adjustable especially by a youngster. Similarly, although it is known to use a tethered ball or a tee device for allowing young players to practice by hitting at stationary balls, conventional devices do not provide the youngster with a convenient way to practice these various types of stationary ball-hitting techniques. It is further noted that to provide a youngster with such a wide range of practice capabilities tends to be relatively expensive.

SUMMARY OF THE INVENTION

In view of the foregoing and other limitations of the prior art, it is a general object of the present invention to provide an improved apparatus that is particularly useful for teaching children how to hit and pitch a ball.

A more particular object is to provide such a device that has ball pitch-back capabilities, as well as tether ball and tee-ball capabilities, which capabilities are quickly and easily adjustable.

A further object is to provide such sports training equipment that is relatively inexpensive.

Yet another object is to provide such a device without hard surfaces and sharp edges, which is safer for children.

These, and other objects and advantages, are provided by the present invention of a combination ball-pitch-back and ball-hitting training device, including a support pole having a lower end for engaging the ground to hold the support pole in an upright position, and a vertical extension member telescopically mounted in the upper end of the support pole for vertical adjustment, and a frame for supporting a rebound net connected to the upper end of the extension member for pivotal adjustment of the rebound net about a horizontal axis, and a ball suspended by way of a tether line attached to a lower part of the rebound net frame whereby upward rotation of the tethered ball and line about the attachment point will carry the ball along a path that intercepts the rebound net. There is a horizontally extending tee support arm having one end connected to the support pole for vertical adjustment along the pole, and for rotational adjustment about the vertical axis of the pole, the other end of the support arm having tee means for releasably supporting a ball. In a preferred embodiment, the lower end of the support pole is adapted for insertion in the ground.

DETAILED DESCRIPTION OF THE INVENTION

Figure 1:
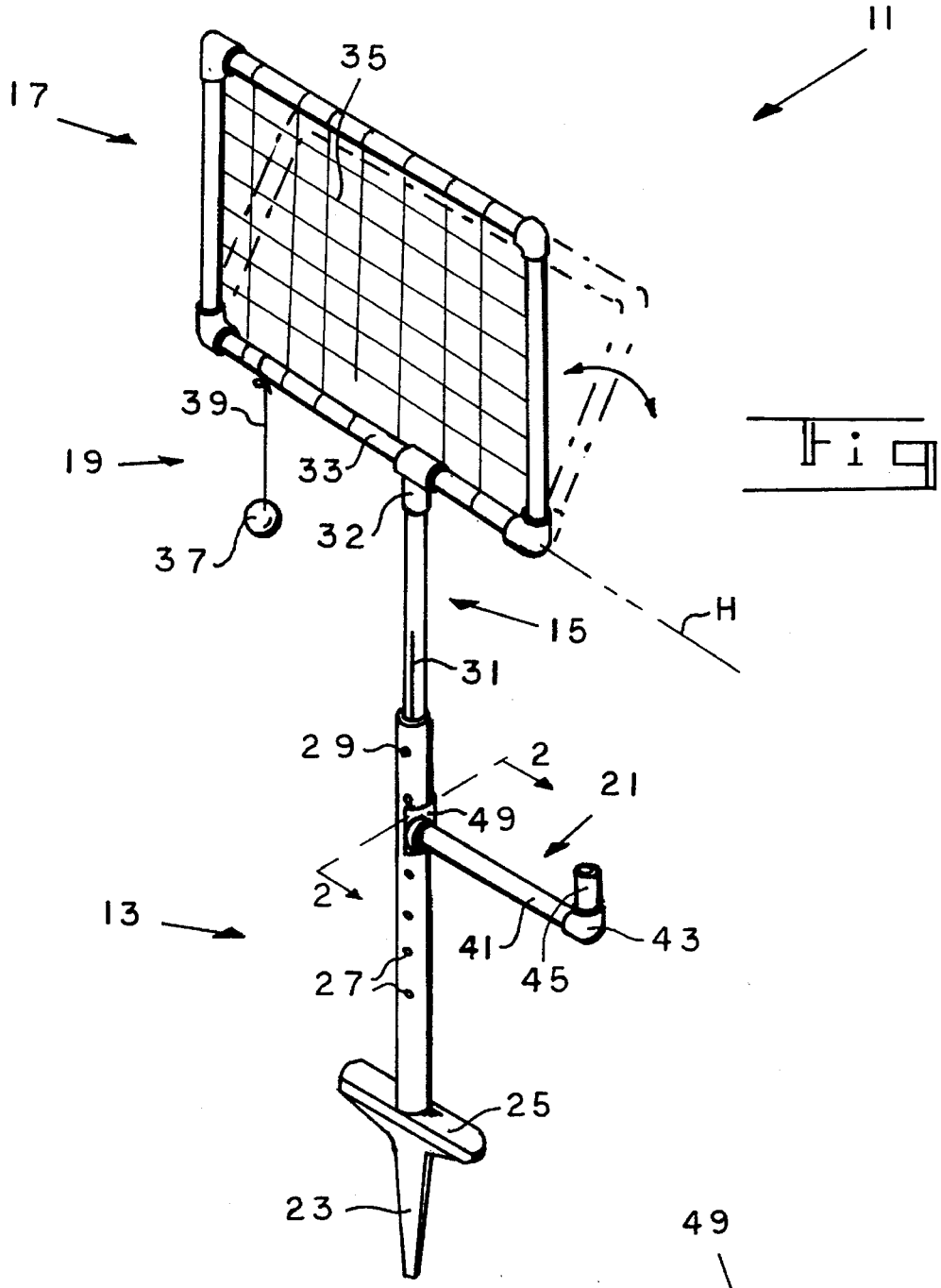
FIG. 1 is a perspective view of a preferred embodiment of a combination ball-pitch-back and ball-hitting apparatus according to the present invention.

Referring now to the drawings, FIG. 1 shows that the main components of a preferred embodiment of a combination device 11 for ball hitting and ball pitching practice, according to the present invention, includes a support pole 13, a vertical extension member 15, a ball rebounder 17, a tethered ball assembly 19, and an adjustable tee assembly 21.

First, it is noted that the above-mentioned components are fabricated primarily of tubular ABS or PVC plastic and plastic fittings. Note that the lower end of the support pole 13 is affixed to an anchor member that has a pointed ground-penetrating stake portion 23, and a horizontal foot-stop 25. Also note that pole 13 is provided with a plurality of vertically aligned holes 27, and a resiliently depressable latch-button 29, of well-known design, is mounted within a lower portion of the extension arm 15, the button 29 being adapted for releasably engaging any one of the holes 27, the extension arm 13 being telescopically slidable within pole 15 to bring the button 29, once depressed, into engagement with any selected one of the holes 27. In order to facilitate alignment of button 29 with selected ones of holes 27, a vertical line 31, partially shown, and aligned with the button 29, is provided along the surface of extension arm 15, as illustrated.

A T-connector 32 is affixed to the upper end of extension arm 15, and the lower frame member 33 of the ball rebounder 17 is snugly received within the horizontal bore of the T-connector 31, the fit being sufficient to allow rotation of the rebounder 17 about a horizontal axis H, yet having sufficient friction to hold rebounder 17 in any angular orientation to which it is manually adjusted. As FIG. 1 shows, the rebounder 17 includes other tubular members secured by suitable elbow fittings into a rectangular frame that mounts a conventional rebounding net 35.

The tethered ball assembly 19 includes a ball 37 and a line 39 that secures it to frame member 33, as illustrated in FIG. 1. Note that the tethered ball assembly 19 is so-positioned such that when ball 37 is hit so as to rotate it about the axis H, it will swing up and rebound off the net 35 so as to prevent undesirable wrapping of line 39 around the frame member 33.

Figure 2:
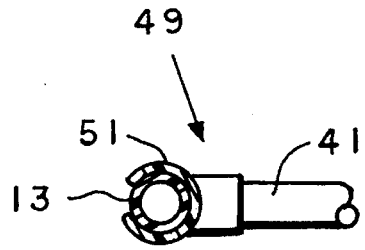
FIG. 2 is a partial sectional view taken along the lines 2—2 of FIG. 1.

The ball tee assembly 21 includes a straight tubular piece 41 to which a 90° elbow 43 is affixed. A short upright tubular piece 45 is secured in the other end of elbow 43, and its open end will serve as a prop upon which a ball can be supported. The other end of the arm 41 is affixed in a slip T-fitting 49 which, as best shown in FIG. 2 has a slotted portion 51 which resiliently embraces the support pole 13. The resulting connection allows the ball tee assembly 21 to be manually slid vertically along the support pole 13 for vertical adjustment, and also rotated as required about the vertical axis of pole 13; however, there is sufficient frictional force to hold the fitting 49 in whatever position it is maneuvered into.

While there has been described a particular embodiment of the invention, it will be obvious to those skilled in the art that various changes and modifications may be made therein without departing from the invention; therefore, it is aimed to cover all such changes and modifications as fall within the true scope and breadth of the invention as defined in the claims which follow.

What is claimed is:

1. Apparatus for practicing ball hitting and pitching including:

a. a support post having a lower end and an upper end, and having means for anchoring the pole to the ground and holding it in an upright position, secured to its lower end;

b. an extension member mounted to the upper portion of said pole for relative telescopic movement;

c. releasable latch means for securing the extension member against vertical movement relative to said pole at selected levels of vertical telescopic adjustment;

d. a frame for supporting a ball-rebounding net, and including a horizontally extending lower portion, and means mounting said frame lower portion to the upper end of said extension member for rotational adjustment of said frame about a horizontal axis;

e. a ball and a tether line, the lower end of the line connected to the ball and the upper end of the line connected to the lower portion of said frame at a location laterally spaced from said extension arm, whereby said ball can be suspended by said line and whereby said ball is rotatable about the connection point of said line along a path that will intercept said rebounding net; and f. a ball tee assembly having a horizontally extending arm and having means upon which a ball can be stationarily and releasably supported at one end of the arm, and means, on the opposite end of said arm, for connecting said arm slidably to the support pole in a manner that allows relative vertical adjustment along said pole and rotational adjustment about the vertical axis of said pole by said arm.

2. Apparatus as defined in claim I wherein said frame mounting means comprises a connector that slidably embraces the lower portion of said frame with sufficient grasping force to generate a residual friction that holds said frame against rotation from a position in which it is manually placed.

3. Apparatus as defined in claim 1 wherein said anchoring means comprises a pointed ground-penetrating stake and a horizontally extending foot-push portion at the upper part of said stake.

* * * * *